US008980167B2

(12) United States Patent
Kimura et al.

(10) Patent No.: US 8,980,167 B2
(45) Date of Patent: Mar. 17, 2015

(54) STAINLESS STEEL PIPE HAVING EXCELLENT EXPANDABILITY FOR OIL COUNTRY TUBULAR GOODS

(75) Inventors: Mitsuo Kimura, Tokyo (JP); Yoshio Yamazaki, Tokyo (JP); Masahito Tanaka, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 17 days.

(21) Appl. No.: 11/919,158

(22) PCT Filed: Feb. 24, 2006

(86) PCT No.: PCT/JP2006/304032

§ 371 (c)(1), (2), (4) Date: Nov. 26, 2007

(87) PCT Pub. No.: WO2006/117926

PCT Pub. Date: Nov. 9, 2006

(65) Prior Publication Data

US 2008/0310990 A1 Dec. 18, 2008

(30) Foreign Application Priority Data

| | | |
|---|---|---|
| Apr. 28, 2005 | (JP) | 2005-131477 |
| Nov. 28, 2005 | (JP) | 2005-342269 |
| Nov. 28, 2005 | (JP) | 2005-342270 |

(51) Int. Cl.

| | |
|---|---|
| ***C22C 38/18*** | (2006.01) |
| ***C22C 38/58*** | (2006.01) |
| ***C22C 38/38*** | (2006.01) |
| ***C22C 38/00*** | (2006.01) |
| ***C21D 6/00*** | (2006.01) |
| ***C21D 8/10*** | (2006.01) |
| ***C21D 9/08*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |

(52) U.S. Cl.

CPC ..... *C22C 38/002* (2013.01); *C21D 6/004* (2013.01); *C21D 8/10* (2013.01); *C21D 9/08* (2013.01); *C22C 38/001* (2013.01); *C22C 38/02* (2013.01); *C22C 38/04* (2013.01); *C22C 38/42* (2013.01); *C22C 38/44* (2013.01); *C22C 38/46* (2013.01)

USPC ..... 420/34; 420/57; 420/56; 420/8

(58) Field of Classification Search

None

See application file for complete search history.

(56) References Cited

U.S. PATENT DOCUMENTS

| | | | |
|---|---|---|---|
| 6,464,802 | B1 | 10/2002 | Miyata et al. |
| 2003/0066580 | A1 | 4/2003 | Miyata et al. |
| 2004/0238079 | A1 | 12/2004 | Kimura et al. |
| 2005/0224143 | A1 | 10/2005 | Takabe et al. |

FOREIGN PATENT DOCUMENTS

| | | | | |
|---|---|---|---|---|
| JP | 06-041638 | A | 2/1994 | |
| JP | 2002-004009 | A | 1/2002 | |
| JP | 2002-105604 | * | 4/2002 | ..... C22C 38/00 |
| JP | 2002-105604 | A | 4/2002 | |
| JP | 2002/180210 | A | 6/2002 | |
| JP | 2003/071589 | A | 3/2003 | |
| WO | WO 98/00626 | A1 | 1/1998 | |

OTHER PUBLICATIONS

Communication from the EP Patent Office dated Jun. 30, 2010 (5 pages) in the counterpart EP application EP 06 72 8594 which includes the European Search Report and the European Search Opinion.

* cited by examiner

*Primary Examiner* — Yoshitoshi Takeuchi
(74) *Attorney, Agent, or Firm* — RatnerPrestia

(57) ABSTRACT

There is provided a cost-effective stainless steel pipe having excellent expandability for oil country tubular goods, the stainless steel pipe having excellent $CO_2$ corrosion resistance under a severe corrosive environment containing $CO_2$, $Cl^-$, and the like. The stainless steel pipe having excellent expandability for oil country tubular goods contains 0.05% or less C, 0.50% or less Si, Mn: 0.10% to 1.50%, 0.03% or less P, 0.005% or less S, 10.5% to 17.0% Cr, 0.5% to 7.0% Ni, 3.0% or less Mo, 0.05% or less Al, 0.20% or less V, 0.15% or less N, and 0.008% or less O, optionally at least one selected from Nb, Cu, Ti, Zr, Ca, B, and W, in a specific content, and the balance being Fe and incidental impurities, wherein a microstructure mainly having a tempered martensitic phase has an austenitic phase content exceeding 20%.

2 Claims, No Drawings

STAINLESS STEEL PIPE HAVING EXCELLENT EXPANDABILITY FOR OIL COUNTRY TUBULAR GOODS

This application is the United States national phase application of International Application PCT/JP2006/304032 filed Feb. 24, 2006.

TECHNICAL FIELD

The present invention relates to steel products for oil country tubular goods used in oil wells for crude oil and gas wells for natural gas. In particular, the present invention relates to a stainless steel pipe having excellent expandability for oil country tubular goods, the stainless steel pipe having high expandability and high corrosion resistance and being suitable for use in extremely severe corrosive wells producing oil and gas containing carbon dioxide ($CO_2$), chlorine ions ($Cl^-$), and the like.

BACKGROUND ART

In recent years, deep oil fields (including gas fields) that had not previously received attention have been actively developed on a global scale because of high oil prices and the imminent exhaustion of oil resources predicted in the near future. The depth of such oil fields (or gas fields) is generally very large. Their high-temperature atmospheres containing $CO_2$, $Cl^-$, and the like are severe corrosive environments. Thus, oil country tubular goods used for drilling such oil fields and gas fields need to be composed of materials having high strength and corrosion resistance. Oil field development in cold climate areas is also increasing; hence, the materials are often required to have low-temperature toughness as well as high strength.

The development of such deep oil wells disadvantageously requires a high drilling cost. A technique for expanding a relatively small pipe in an oil well has recently been brought into practical use (for example, see Patent Documents 1 and 2). The employment of the technique results in a reduction in the cross-sectional area of a drilling hole, thus reducing drilling costs. However, the tubular goods are required to have excellent expandability.

Patent Document 1: PCT Japanese Translation Patent Publication No. 7-567010

Patent Document 2: WO98/00626

DISCLOSURE OF INVENTION

In general, 13% Cr martensitic stainless steel pipes having $CO_2$ corrosion resistance are used under environments containing $CO_2$, $Cl^-$, and the like. Disadvantageously, martensitic stainless steel pipes subjected to normal quenching and tempering do not have sufficient expandability. To employ the new technique for expanding a pipe in an oil well, the development of a stainless steel pipe having excellent $CO_2$ corrosion resistance and excellent expandability for oil country tubular goods is highly desirable.

In the above-described situation, it is an object of the present invention to provide a cost-effective stainless steel pipe having excellent expandability for oil country tubular goods, the stainless steel pipe having excellent $CO_2$ corrosion resistance and excellent expandability under a severe corrosive environment containing $CO_2$, $Cl^-$, and the like.

To achieve the object, the inventors have focused their attention on a martensitic stainless steel pipe believed to be suitable for oil country tubular goods from the viewpoint of $CO_2$ corrosion resistance and have planned to improve the expandability thereof by controlling the microstructure thereof. The inventors have conducted intensive studies and experiments to investigate the corrosion resistance of various alloys mainly composed of 13% Cr steel, which is typical martensitic stainless steel, in an environment containing $CO_2$ and $Cl^-$, in line with this strategy. The inventors have found that in 13% Cr steel having a C content markedly lower than that in the known art, the incorporation of Ni and V, a reduction in contents of S, Si, Al, and O, limitation of contents of elements of alloys to within specific ranges, and preferably the control of a microstructure result in satisfactory hot workability, corrosion resistance and significantly improve expandability. These findings have led to the completion of the present invention. The gist of the present invention will be described below.

A high-strength martensitic stainless steel pipe of the present invention for oil country tubular goods can be categorized into one of three groups.

Group 1

1. A stainless steel pipe having excellent expandability for oil country tubular goods contains, on a percent by mass basis, 0.01% to 0.05% C, 0.50% or less Si, 0.10% to 1.50% Mn, 0.03% or less P, 0.005% or less S, 12.0% to 17.0% Cr, 2.0% to 7.0% Ni, 3.0% or less Mo, 0.05% or less Al, 0.20% or less V, 0.01% to 0.15% N, and the balance being Fe and incidental impurities, wherein a microstructure mainly having a tempered martensitic phase has an austenitic phase content exceeding 20%.

2. A stainless steel pipe having excellent expandability for oil country tubular goods contains, on a percent by mass basis, 0.01% to 0.05% C, 0.50% or less Si, 0.30% to 1.50% Mn, 0.03% or less P, 0.005% or less S, 12.0% to 17.0% Cr, 2.0% to 7.0% Ni, 3.0% or less Mo, 0.05% or less Al, 0.20% or less v, 0.01% to 0.15% N, at least one selected from 0.20% or less Nb, 3.5% or less Cu, 0.3% or less Ti, 0.2% or less Zr, 0.0005% to 0.01% Ca, 0.01% or less B, and 3.0% or less W, and the balance being Fe and incidental impurities, wherein a microstructure mainly having a tempered martensitic phase has an austenitic phase content exceeding 20%.

Group 2

1. A stainless steel pipe having excellent expandability for oil country tubular goods contains a steel composition of, on a percent by mass basis, less than 6.010% C, 0.50% or less Si, 0.10% to 1.50% Mn, 0.03% or less P, 0.005% or less S, 11.0% to 15.0% Cr, 2.0% to 7.0% Ni, 3.0% or less Mo, 0.05% or less Al, 0.20% or less V, less than 0.01% N, 0.008% or less O, and the balance being Fe and incidental impurities, wherein a steel microstructure has tempered martensite as a main phase and an austenite content exceeding 20 percent by volume.

2. A stainless steel pipe having excellent expandability for oil country tubular goods contains a steel composition of, on a percent by mass basis, less than 0.010% C, 0.50% or less Si, 0.10% to 1.50% Mn, 0.03% or less P, 0.005% or less S, 11.0% to 15.0% Cr, 2.0% to 7.0% Ni, 3.0% or less Mo, 0.05% or less Al, 0.20% or less V, less than 0.01% N, 0.008% or less O, at least one selected from 0.20% or less Nb, 3.5% or less Cu, 0.3% or less Ti, 0.2% or less Zr, 0.001% to 0.01% Ca, 0.0005% to 0.01% B, and 3.0% or less W, and the balance being Fe and incidental impurities, wherein a steel microstructure has tempered martensite as a main phase and an austenite content exceeding 20 percent by volume.

3. The stainless steel pipe having excellent expandability for oil country tubular goods according to claim 1 or 2, wherein an austenite content exceeding 20 percent by volume is replaced with a quenched martensite content of 3 percent by volume or more and an austenite content of 15 percent by volume or more.

Group 3

1. A stainless steel pipe having excellent expandability for oil country tubular goods contains a steel composition of, on a percent by mass basis, 0.05% or less C, 0.50% or less Si, 0.10% to 1.50% Mn, 0.03% or less P, 0.005% or less S, 10.5% to 17.0% Cr, 0.5% to 7.0% Ni, 0.05% or less Al, 0.20% or less V, 0.15% or less N, 0.008% or less O, and the balance being Fe and incidental impurities, wherein Cr+0.5Ni−20C>11.3 is satisfied.

2. A stainless steel pipe having excellent expandability for oil country tubular goods contains a steel composition of, on a percent by mass basis, 0.05% or less C, 0.50% or less Si, 0.10% to 1.50% Mn, 0.03% or less P, 0.005% or less S, 10.5% to 17.0% Cr, 0.5% to 7.0% Ni, 0.05% or less Al, 0.20% or less V, 0.15% or less N, 0.008% or less O, at least one selected from 0.20% or less Nb, 3.5% or less Cu, 0.3% or less Ti, 0.2% or less Zr, 0.001% to 0.01% Ca, 0.0005% to 0.01% B, and 3.0% or less W, and the balance being Fe and incidental impurities, wherein Cr+0.5Ni−20C+0.45Cu+0.4 W>11.3 is satisfied.

3. The stainless steel pipe having excellent expandability for oil country tubular goods according to claim 1 or 2, wherein a steel microstructure has tempered martensite as a main phase and an austenite content exceeding 5 percent by volume.

4. The stainless steel pipe having excellent expandability for oil country tubular goods according to claim 1 or 2, wherein a steel microstructure has tempered martensite as a main phase and a quenched martensite content of 3 percent by volume or more.

5. The stainless steel pipe having excellent expandability for oil country tubular goods according to claim 1 or 2, wherein a steel microstructure has tempered martensite as a main phase, a quenched martensite content of 3 percent by volume or more, and an austenite content of 5 percent by volume or more.

BEST MODE FOR CARRYING OUT THE INVENTION

The reason for the limitation of the contents of the components of the stainless steel pipe included in Group 1 of the present invention for oil country tubular goods will be described below. The units of the content of each component in the steel composition are percent by mass and are simply indicated by %.

C: 0.01% to 0.05%

C relates to the strength of the martensitic stainless steel and is thus an important element. The C content needs to be 0.01% or more. However, the incorporation of Ni described below is liable to cause sensitization during tempering. To prevent sensitization, the C content needs to be 0.05% or less. Thus, the C content is set in the range of 0.01% to 0.05%. A lower C content is desirable also from the viewpoint of corrosion resistance. Thus, the C content is preferably in the range of 0.01% to 0.03%.

Si: 0.50% or less

Si is an element needed as a deoxidizer in a usual steelmaking process. A Si content exceeding 0.50% degrades $CO_2$ corrosion resistance and hot workability. Thus, the Si content is set to 0.50% or less.

Mn: 0.10% to 1.50%

The Mn content needs to be 0.10% or more in order to ensure the strength required for martensitic stainless steel for oil country tubular goods. A Mn content exceeding 1.50% adversely affects toughness. Thus, the Mn content is set in the range of 0.10% to 1.50% and preferably 0.30% to 1.00%.

P: 0.03% or less

P is an element that degrades $CO_2$ corrosion resistance, resistance to $CO_2$ stress corrosion cracking, pitting corrosion resistance, and resistance to sulfide stress corrosion cracking. The P content is preferably minimized. However, an extreme reduction in P content increases production costs. In view of providing an allowable range in which the production can be industrially performed at relatively low costs and in which $CO_2$ corrosion resistance, resistance to $CO_2$ stress corrosion cracking, pitting corrosion resistance, and resistance to sulfide stress corrosion cracking are not degraded, the P content is set to 0.03% or less.

S: 0.005% or less

S is an element that significantly degrades hot workability in a process of manufacturing a steel pipe. The S content is preferably minimized. At a S content of 0.005% or less, the steel pipe can be manufactured by a common process. Thus, the upper limit of the S content is set to 0.005%. Preferably, the S content is 0.003% or less.

Cr: 12.0% to 17.0%

Cr is a main element used to ensure $CO_2$ corrosion resistance and resistance to $CO_2$ stress corrosion cracking. From the viewpoint of corrosion resistance, the Cr content needs to be 12.0% or more. However, a Cr content exceeding 17.0% degrades hot workability. Thus, the Cr content is set in the range of 12.0% to 17.0% and preferably 12.0% to 15.0%.

Ni: 2.0% to 7.0%

Ni is incorporated in order to strengthen a protective film to improve $CO_2$ corrosion resistance, resistance to $CO_2$ stress corrosion cracking, pitting corrosion resistance, and resistance to sulfide stress corrosion cracking and in order to increase the strength of 13% Cr steel having a lower C content. At a Ni content of less than 2.0%, the effect is not provided. A Ni content exceeding 7.0% reduces the strength. Thus, the Ni content is set in the range of 2.0% to 7.0%.

Mo: 3.0% or less

Mo is an element that imparts resistance to pitting corrosion due to $Cl^-$. A Mo content exceeding 3.0% results in the formation of δ ferrite, thereby degrading $CO_2$ corrosion resistance, resistance to $CO_2$ stress corrosion cracking, and hot workability. Furthermore, the cost is increased. Thus, the Mo content is set to 3.0% or less. In view of cost, the Mo content is preferably set to 2.2% or less.

Al: 0.05% or less

Al has a strong deoxidizing effect. An Al content exceeding 0.05% adversely affects toughness. Thus the Al content is set to 0.05% or less.

V: 0.20% or less

V has effects of increasing strength and improving resistance to stress corrosion cracking. A V content exceeding 0.2% degrades toughness. Thus, the V content is set to 0.20% or less.

N: 0.01% to 0.15%

N is an element that significantly improves pitting corrosion resistance. At a N content of less than 0.01%, the effect is not sufficient. A N content exceeding 0.5% results in the formation of various nitrides, thereby degrading toughness. Thus, the N content is set in the range of 0.01% to 0.15%.

O: 0.008% or less

O is a significantly important element for sufficiently exhibiting the performance of the steel of the present invention. A higher 0 content results in the formation of various oxides, thereby significantly degrading hot workability, resistance to $CO_2$ stress corrosion cracking, pitting corrosion resistance, and resistance to sulfide stress corrosion cracking. Thus, the 0 content is set to 0.008% or less.

Nb: 0.20% or less

Nb has effects of improving toughness and increasing strength. However, a Nb content exceeding 0.20% reduces toughness. Thus, the Nb content is set to 0.20% or less.

Ca: 0.0005% to 0.01%

Ca fixes S as CaS and spheroidizes sulfide inclusions, thereby reducing the lattice strain of the matrix around the inclusions to reduce their ability to trap hydrogen. At a Ca content of less than 0.001%, the effect is less marked. A Ca content exceeding 0.01% increases formation of CaO, thereby degrading $CO_2$ corrosion resistance and pitting corrosion resistance. Thus, the Ca content is set in the range of 0.001% to 0.01%.

Cu: 3.5% or less

Cu is an element which strengthens the protective film, inhibits the penetration of hydrogen into steel, and improves resistance to sulfide stress corrosion cracking. A Cu content exceeding 3.5% causes the grain boundary precipitation of CuS at a high temperature, thereby degrading hot workability. Thus, the Cu content is set to 3.5% or less.

Ti: 0.3% or less, Zr: 0.2% or less, B: 0.0005% to 0.01%, W: 3.0% or less

Ti, Zr, B, and W have effects of increasing strength and improving resistance to stress corrosion cracking. Toughness is reduced at a Ti content exceeding 0.3%, a Zr content exceeding 0.2%, or a W content exceeding 3.0%. A B content of less than 0.0005% produces no effect. A B content exceeding 0.01% degrades toughness. Thus, the Ti content is set to 0.3% or less. The Zr content is set to 0.2% or less. The B content is set in the range of 0.0005% to 0.01%. The W content is set to 3.0% or less.

A tempered martensitic phase containing an austenitic phase of more than 10% and a quenched martensitic phase of 3% or more exhibits stable expandability. In addition, a ferrite phase of 3% or less may be contained in a microstructure.

In the present invention, from the viewpoint of hot workability, significantly low contents of S, Si, Al, and O improve hot workability. Thus, in the case where oil country tubular goods are produced with the steel, a common production process may be employed without any modification.

A preferred method for producing a stainless pipe included in Group 1 of the present invention for oil country tubular goods will be described below using a seamless steel pipe by way of example. Preferably, molten steel having the composition described above is formed into an ingot by a known ingot-forming method using a converter, an electric furnace, a vacuum melting furnace, or the like, followed by formation of articles, such as billets, for steel pipes using a known method including a continuous casting method or an ingot-making bloom rolling method.

These articles for steel pipes are heated and processed by hot working for making pipes using a production process such as a general Mannesmann-plug mill process or Mannesmann-mandrel mill process, thereby forming seamless steel pipes having desired dimensions. After pipe-making, the seamless steel pipes are preferably cooled to room temperature at a cooling rate higher than that of air cooling. After hot working, the articles may be subjected to rolling and cooling, as described above. Preferably, tempering or quenching and tempering are performed. Preferably, quenching may be performed by reheating the articles to 800° C. or higher, maintaining the articles at the temperature for 5 minutes or more, and cooling the articles to 200° C. or lower and preferably to room temperature at a cooling rate higher than that of air cooling.

At a heating temperature of 800° C. or lower, a sufficient martensite microstructure cannot be obtained, thereby reducing strength, in some cases. Tempering is preferably performed by heating the articles to a temperature-exceeding the $A_{C1}$ temperature. Tempering at a temperature exceeding the $A_{C1}$ temperature results in the precipitation of austenite or quenched martensite. Alternatively, in place of quenching and tempering described above, only tempering may be performed by heating the articles to a temperature equal to or higher than the $A_{C1}$ temperature.

Although the seamless steel pipe as an example has been described above, the heat-treatment process may be applied to electric resistance welded pipes and welded steel pipes, except for the pipe-making process.

The reason for the limitation of the contents of the components of the stainless steel pipe included in Group 2 of the present invention for oil country tubular goods will be described below.

C: less than 0.010%

C relates to the strength of the martensitic stainless steel and is thus an important element. A higher C content increases the strength thereof. However, from the viewpoint of expandable steel pipes, the strength before expansion is preferably low. Thus, the C content is set to less than 0.010%.

Si: 0.50% or less

Si is an element needed as a deoxidizer in a usual steel-making process. A Si content exceeding 0.50% degrades $CO_2$ corrosion resistance and hot workability. Thus, the Si content is set to 0.50% or less.

Mn: 0.10% to 1.50%

The Mn content needs to be 0.10% or more in order to ensure the strength required for martensitic stainless steel for oil country tubular goods. A Mn content exceeding 1.50% adversely affects toughness. Thus, the Mn content is set in the range of 0.10% to 1.50% and preferably 0.30% to 1.00%.

P: 0.03% or less

P is an element that degrades $CO_2$ corrosion resistance, resistance to $CO_2$ stress corrosion cracking, pitting corrosion resistance, and resistance to sulfide stress corrosion cracking. The P content is preferably minimized. However, an extreme reduction in P content increases production costs. In view of providing an allowable range in which the production can be industrially performed at relatively low costs and in which resistance to $CO_2$ stress corrosion cracking, pitting corrosion resistance, and resistance to sulfide stress corrosion cracking are not degraded, the P content is set to 0.03% or less.

S: 0.005% or less

S is an element that significantly degrades hot workability in a process of manufacturing a pipe. The S content is preferably minimized. At a S content of 0.005% or less, the steel pipe can be manufactured by a common process. Thus, the upper limit of the S content is set to 0.005%. Preferably, the S content is 0.003% or less.

Cr: 11.0% to 15.0%

Cr is a main element used to ensure $CO_2$ corrosion resistance and resistance to $CO_2$ stress corrosion cracking. From the viewpoint of corrosion resistance, the Cr content needs to be 11.0% or more. However, a Cr content exceeding 15.0% degrades hot workability. Thus, the Cr content is set in the range of 11.0% to 15.0% and preferably 11.5% to 14.0%.

Ni: 2.0% to 7.0%

Ni is incorporated in order to strengthen a protective film to improve $CO_2$ corrosion resistance, resistance to $CO_2$ stress corrosion cracking, pitting corrosion resistance, and resistance to sulfide stress corrosion cracking and in order to increase the strength of 13% Cr steel having a lower C content. At a Ni content of less than 2.0%, the effect is not provided. A Ni content exceeding 7.0% reduces the strength. Thus, the Ni content is set in the range of 2.0% to 7.0%.

Mo: 3.0% or less

Mo is an element that imparts resistance to pitting corrosion due to $Cl^-$. A Mo content exceeding 3.0% results in the formation of δ ferrite, thereby degrading $CO_2$ corrosion resistance, resistance to $CO_2$ stress corrosion cracking, and hot workability. Furthermore, the cost is increased. Thus, the Mo content is set to 3.0% or less. In view of cost, the Mo content is preferably set in the range of 0.1% to 2.2%.

Al: 0.05% or less

Al has a strong deoxidizing effect. An Al content exceeding 0.05% adversely affects toughness. Thus the Al content is set to 0.05% or less.

V: 0.20% or less

V has effects of increasing strength and improving resistance to stress corrosion cracking. A V content exceeding 0.2% degrades toughness. Thus, the V content is set to 0.20% or less.

N: less than 0.01%

N is an element that significantly improves pitting corrosion resistance. N is an important element that relates to the strength of martensitic stainless steel. A higher N content increases the strength thereof. However, for expandable stainless steel pipes, the strength before expansion is preferably low. Thus, the N content is set to less than 0.01%.

O: 0.008% or less

O is a significantly important element for sufficiently exhibiting the performance of the steel pipe of the present invention. In particular, the O content needs to be controlled. A higher O content results in the formation of various oxides, thereby significantly degrading hot workability, resistance to $CO_2$ stress corrosion cracking, pitting corrosion resistance, and resistance to sulfide stress corrosion cracking. Thus, the O content is set to 0.008% or less.

The steel composition according to the present invention may contain at least one selected from 0.2% or less Nb, 3.5% or less Cu, 0.3% or less Ti, 0.2% or less Zr, 0.001% to 0.01% Ca, 0.0005% to 0.01% B, and 3.0% or less W as an additional element.

Nb: 0.20% or less

Nb has effects of improving toughness and increasing strength. However, a Nb content exceeding 0.20% reduces toughness. Thus, the Nb content is set to 0.20% or less.

Ca: 0.001% to 0.01%

Ca fixes S as CaS and spheroidizes sulfide inclusions, thereby reducing the lattice strain of the matrix around the inclusions to reduce their ability to trap hydrogen. At a Ca content of less than 0.001%, the effect is less marked. A Ca content exceeding 0.01% increases formation of CaO, thereby degrading $CO_2$ corrosion resistance and pitting corrosion resistance. Thus, the Ca content is set in the range of 0.001% to 0.01%.

Cu: 3.5% or less

Cu is an element which strengthens the protective film, inhibits the penetration of hydrogen into steel, and improves resistance to sulfide stress corrosion cracking. A Cu content exceeding 3.5% causes the grain boundary precipitation of CuS at a high temperature, thereby degrading hot workability. Thus, the Cu content is set to 3.5% or less.

Ti: 0.3% or less, Zr: 0.2% or less, B: 0.0005% to 0.01%, W: 3.0% or less

Ti, Zr, B, and W have effects of increasing strength and improving resistance to stress corrosion cracking. Toughness is reduced at a Ti content exceeding 0.3%, a Zr content exceeding 0.2%, or a W content exceeding 3.0%. A B content of less than 0.0005% produces no effect. A B content exceeding 0.01% degrades toughness. Thus, the Ti content is set to 0.3% or less. The Zr content is set to 0.2% or less. The B content is set in the range of 0.0005% to 0.01%. The W content is set to 3.0% or less.

The reason for the limitation of the microstructure will be described. To obtain stable expandability, the microstructure of the steel pipe of the present invention has tempered martensite as a main phase (phase of 50 percent by volume or more) and an austenite content exceeding 20 percent by volume. In the case of a quenched martensite content of 3 percent by volume or more and an austenite content of 15 percent by volume or more in place of an austenite content exceeding 20 percent by volume, the same effect is provided.

A preferred method for producing a stainless pipe included in Group 2 of the present invention for oil country tubular goods will be described below using a seamless steel pipe by way of example. Preferably, molten steel having the composition described above is formed into an ingot by a known ingot-forming method using a converter, an electric furnace, a vacuum melting furnace, or the like, followed by formation of articles, such as billets, for steel pipes using a known method including a continuous casting method or an ingot-making bloom rolling method. These articles for steel pipes are heated and processed by hot working for making pipes using a production process such as a general Mannesmann-plug mill process or Mannesmann-mandrel mill process, thereby forming seamless steel pipes having desired dimensions. After pipe-making, the seamless steel pipes are preferably cooled to room temperature at a cooling rate higher than that of air cooling.

The steel pipes cooled after pipe-making may be used as steel pipes of the present invention. Preferably, the steel pipes cooled after pipe-making are subjected to tempering or quenching and tempering.

Preferably, quenching may be performed by reheating the articles to 800° C. or higher, maintaining the articles at the temperature for 5 minutes or more, and cooling the articles to 200° C. or lower and preferably to room temperature at a cooling rate higher than that of air cooling. At a heating temperature of 800° C. or lower, a sufficient martensite microstructure cannot be obtained, thereby reducing strength, in some cases.

Tempering after quenching is preferably performed by heating the articles to a temperature exceeding the $A_{C1}$ temperature. Tempering at a temperature exceeding the $A_{C1}$ temperature results in the precipitation of austenite or quenched martensite.

In the case where the steel pipes cooled after pipe-making are subjected to tempering alone, the steel pipes are preferably heated to a temperature between the $A_{C1}$ temperature and 700° C.

In the present invention, from the viewpoint of hot workability, significantly low contents of S, Si, Al, and O improve hot workability of the steel. Thus, in the case where steel pipes are produced with the steel, a common production process may be employed without any modification. The steel of the present invention may be applied to electric resistance welded pipes and UOE steel pipes as well as seamless steel pipes.

The reason for the limitation of the contents of the components of the stainless steel pipe included in Group 3 of the present invention for oil country tubular goods will be described below.

C: 0.05% or less

C relates to the strength of the martensitic stainless steel and is thus an important element. To sufficiently ensure expandability, the C content needs to be 0.05% or less. During tempering, C causes precipitation of chromium carbides, thereby degrading corrosion resistance. To prevent the degradation of corrosion resistance, the C content needs to be 0.05% or less. Thus, the C content is set to 0.05% or less. Preferably, the C content is 0.03% or less.

Si: 0.50% or less

Si is an element needed as a deoxidizer in a usual steelmaking process. A Si content exceeding 0.50% degrades $CO_2$ corrosion resistance and hot workability. Thus, the Si content is set to 0.50% or less.

Mn: 0.10% to 1.50%

The Mn content needs to be 0.10% or more in order to ensure the strength required for martensitic stainless steel for oil country tubular goods. A Mn content exceeding 1.50% adversely affects toughness. Thus, the Mn content is set in the range of 0.10% to 1.50% and preferably 0.30% to 1.00%.

P: 0.03% or less

P is an element that degrades $CO_2$ corrosion resistance, resistance to $CO_2$ stress corrosion cracking, pitting corrosion resistance, and resistance to sulfide stress corrosion cracking. The P content is preferably minimized. However, an extreme reduction in P content increases production costs. Also from the viewpoint of hot workability, a lower P content is preferred. In view of providing an allowable range in which the production can be industrially performed at relatively low costs and in which $CO_2$ corrosion resistance, resistance to $CO_2$ stress corrosion cracking, pitting corrosion resistance, and resistance to sulfide stress corrosion cracking are not degraded, the P content is set to 0.03% or less.

S: 0.005% or less

S is an element that significantly degrades hot workability in a process of manufacturing a pipe. The S content is preferably minimized. At a S content of 0.005% or less, the steel pipe can be manufactured by a common process. Thus, the upper limit of the S content is set to 0.005%. Preferably, the S content is 0.003% or less.

Cr: 10.5% to 17.0%

Cr is a main element used to ensure $CO_2$ corrosion resistance and resistance to $CO_2$ stress corrosion cracking. From the viewpoint of corrosion resistance, the Cr content needs to be 10.5% or more. However, a Cr content exceeding 17.0% degrades hot workability. Thus, the Cr content is set in the range of 10.5% to 17.0% and preferably 10.5% to 13.5%.

Ni: 0.5% to 7.0%

Ni is incorporated in order to strengthen a protective film to improve $CO_2$ corrosion resistance, resistance to $CO_2$ stress corrosion cracking, pitting corrosion resistance, and resistance to sulfide stress corrosion cracking and in order to increase the strength of 13% Cr steel having a lower C content. At a Ni content of less than 0.5%, the effect is not provided. A Ni content exceeding 7.0% reduces the strength. Thus, the Ni content is set in the range of 0.5% to 7.0%. Preferably, the Ni content is set in the range of 1.0% to 3.0%.

Al: 0.05% or less

Al has a strong deoxidizing effect. An Al content exceeding 0.05% adversely affects toughness. Thus the Al content is set to 0.05% or less.

V: 0.20% or less

V has effects of increasing strength and improving resistance to stress corrosion cracking. A V content exceeding 0.2% degrades toughness. Thus, the V content is set to 0.20% or less.

N: 0.15% or less

N is an element that significantly improves pitting corrosion resistance. A N content exceeding 0.15% results in the formation of various nitrides, thereby degrading toughness. Thus, the N content is set to 0.15% or less.

O: 0.008% or less

O is a significantly important element for sufficiently exhibiting the performance of the steel of the present invention. A higher O content results in the formation of various oxides, thereby significantly degrading hot workability, resistance to $CO_2$ stress corrosion cracking, pitting corrosion resistance, and resistance to sulfide stress corrosion cracking. Thus, the O content is set to 0.008% or less.

The steel composition according to the present invention may contain at least one selected from 0.20% or less Nb, 3.5% or less Cu, 0.3% or less Ti, 0.2% or less Zr, 0.001% to 0.01% Ca, 0.0005% to 0.01% B, and 3.0% or less W as an additional element.

Nb: 0.20% or less

Nb has effects of improving toughness and increasing strength. However, a Nb content exceeding 0.20% reduces toughness. Thus, the Nb content is set to 0.20% or less.

Ca: 0.001% to 0.01%

Ca fixes S as CaS and spheroidizes sulfide inclusions, thereby reducing the lattice strain of the matrix around the inclusions to reduce their ability to trap hydrogen. At a Ca content of less than 0.001%, the effect is less marked. A Ca content exceeding 0.01% increases formation of CaO, thereby degrading $CO_2$ corrosion resistance and pitting corrosion resistance. Thus, the Ca content is set in the range of 0.001% to 0.01%.

Cu: 3.5% or less

Cu is an element which strengthens the protective film, inhibits the penetration of hydrogen into steel, and improves resistance to sulfide stress corrosion cracking. A Cu content exceeding 3.5% causes the grain boundary precipitation of CuS at a high temperature, thereby degrading hot workability. Thus, the Cu content is set to 3.5% or less.

Ti: 0.3% or less, Zr: 0.2% or less, B: 0.0005% to 0.01%, W: 3.0% or less.

Ti, Zr, B, and W have effects of increasing strength and improving resistance to stress corrosion cracking. Toughness is reduced at a Ti content exceeding 0.3%, a Zr content exceeding 0.2%, or a W content exceeding 3.0%. A B content of less than 0.0005% produces no effect. A B content exceeding 0.01% degrades toughness. Thus, the Ti content is set to 0.3% or less. The Zr content is set to 0.2% or less. The B content is set in the range of 0.0005% to 0.01%. The W content is set to 3.0% or less.

$Cr+0.5Ni-20C+0.45Cu+0.4W>11.3$ (where the symbols of the elements represent contents (percent by mass) of the elements in steel, and a term of element that is not contained is ignored)

To obtain sufficient corrosion resistance in a high-temperature carbon-dioxide-gas environment in which a steel pipe of the present invention is used, it is necessary to sufficiently incorporate alloying elements required for corrosion resistance and to reduce the content of C that degrades corrosion resistance. Thus, the relationship $Cr+0.5Ni-20C+0.45Cu+0.4W>11.3$ is determined.

With respect to a steel microstructure, from the viewpoint of providing a stable expandability, preferably, the steel microstructure has tempered martensite as a main phase and one selected from:

an austenite content exceeding 5 percent by volume;

a quenched martensite content of 3 percent by volume or more; and a quenched martensite content of 3 percent by volume or more and an austenite content of 5 percent by volume or more.

A preferred method for producing a stainless pipe included in Group 2 of the present invention for oil country tubular goods will be described below using a seamless steel pipe by way of example. Preferably, molten steel having the composition described above is formed into an ingot by a known ingot-forming method using a converter, an electric furnace, a vacuum melting furnace, or the like, followed by formation of articles, such as billets, for steel pipes using a known method including a continuous casting method or an ingot-making bloom rolling method. These articles for steel pipes are heated and processed by hot working for making pipes using a production process such as a general Mannesmann-plug mill process or Mannesmann-mandrel mill process, thereby forming seamless steel pipes having desired dimensions. After pipe-making, the seamless steel pipes are preferably cooled to room temperature at a cooling rate higher than that of air cooling.

The steel pipes cooled after pipe-making may be used as steel pipes of the present invention. Preferably, the steel pipes cooled after pipe-making are subjected to tempering or quenching and tempering.

Preferably, quenching may be performed by reheating the articles to 800° C. or higher, maintaining the articles at the temperature for 5 minutes or more, and cooling the articles to 200° C. or lower and preferably to room temperature at a cooling rate higher than that of air cooling. At a heating temperature of 800° C. or lower, a sufficient martensite microstructure cannot be obtained, thereby reducing strength, in some cases.

Tempering after quenching is preferably performed by heating the articles to a temperature exceeding the $A_{C1}$ temperature. Tempering at a temperature exceeding the $A_{C1}$ temperature results in the precipitation of austenite or quenched martensite.

In the case where the steel pipes cooled after pipe-making are subjected to tempering alone, the steel pipes are preferably heated to a temperature between the $A_{C1}$ temperature and 700° C.

In the present invention, from the viewpoint of hot workability, significantly low contents of S, Si, Al, and O improve hot workability of the steel. Thus, in the case where steel pipes are produced with the steel, a common production process may be employed without any modification. The steel of the present invention may be applied to electric resistance welded pipes and UOE steel pipes as well as seamless steel pipes.

EXAMPLES

Example 1 of Group 1 of the Invention

Table 1 shows sample symbols and compositions of steels in inventive examples and comparative examples. These molten steels having the chemical compositions were sufficiently degassed and were each formed into a 100-kg steel ingot. Steel pipes each having an outer diameter of 3.3 inches and a thickness of 0.5 inches were formed with a research model seamless rolling mill. Specimens were cut out from the steel pipes and were subjected to quenching and tempering. Furthermore, expandability and corrosion resistance of the steel pipes were tested. Table 2 shows the results of the expandability test. Expandability was evaluated by a method in which a limit of the expansion ratio is determined by insertion of plugs. The evaluation was performed using the plugs such that the expansion ratio in 5% increments was determined. A target expansion ratio is 35% or more.

Furthermore, corrosion test pieces each having a thickness of 3 mm, a width of 30 mm, and a length of 40 mm were formed from 15%-expanded steel pipes by mechanical processing. A corrosion test was performed under conditions described below.

Corrosion Test Conditions

NaCl: 20% aqueous solution, $CO_2$: 30 atoms, temperature: 150° C., test period: 2 weeks.

In the corrosion test, evaluation was based on the corrosion rate obtained by calculation from the reduction in weight of each test piece and observation of the presence or absence of pitting corrosion with a 10-power loupe. Table 2 shows the results.

When the Cr content is 12% or less (type of steel: J), the corrosion rate is increased (No. 15). The allowable limit of the corrosion rate is 0.127 mm/y.

The results demonstrate that the steels of the present invention have high expandability and excellent carbon-dioxide-gas corrosion resistance.

Therefore, the steels of the present invention can be sufficiently used as expandable oil country tubular goods.

In each of Nos. 16 to 19 according to comparative examples, the austenite (γ) content is less than 20%, and the expansion ratio is low.

TABLE 1

| Type of | Chemical composition (mass %) | | | | | | | | | | | | | |
|---|---|---|---|---|---|---|---|---|---|---|---|---|---|---|
| steel | C | Si | Mn | P | S | Al | Cr | Ni | Mo | V | N | O | Cu | Other |
| A | 0.012 | 0.26 | 0.49 | 0.01 | 0.002 | 0.02 | 13.3 | 5.7 | 2.5 | 0.047 | 0.049 | 0.0031 | — | |
| B | 0.011 | 0.28 | 0.45 | 0.02 | 0.002 | 0.01 | 13.3 | 4.3 | 1.2 | 0.057 | 0.053 | 0.0023 | — | Nb: 0.068 |
| C | 0.014 | 0.22 | 0.42 | 0.01 | 0.002 | 0.01 | 12.7 | 4.2 | 1.1 | 0.059 | 0.057 | 0.0027 | — | Ti: 0.036 |
| D | 0.018 | 0.24 | 0.49 | 0.02 | 0.001 | 0.01 | 12.6 | 5.2 | 2.2 | 0.049 | 0.062 | 0.0035 | 0.80 | Zr: 0.025 |
| E | 0.017 | 0.27 | 0.41 | 0.01 | 0.002 | 0.02 | 13.6 | 5.0 | 1.7 | 0.038 | 0.044 | 0.0028 | 1.24 | Ti: 0.021, B: 0.001 |
| F | 0.025 | 0.20 | 0.44 | 0.01 | 0.001 | 0.01 | 12.8 | 5.1 | 2.1 | 0.051 | 0.039 | 0.0025 | — | Ca: 0.002 |
| G | 0.021 | 0.24 | 0.49 | 0.02 | 0.001 | 0.01 | 12.9 | 4.9 | 1.6 | 0.046 | 0.050 | 0.0019 | 0.75 | Nb: 0.044, Ca: 0.001 |
| H | 0.027 | 0.29 | 0.44 | 0.02 | 0.002 | 0.02 | 13.4 | 5.1 | 1.9 | 0.055 | 0.063 | 0.0016 | — | W: 0.26 |
| I | 0.017 | 0.27 | 0.44 | 0.02 | 0.001 | 0.01 | 13.5 | 3.2 | 1.1 | 0.046 | 0.056 | 0.0028 | — | |
| J | 0.026 | 0.23 | 0.42 | 0.01 | 0.002 | 0.02 | 11.7 | 4.8 | 1.7 | 0.055 | 0.106 | 0.0017 | — | |
| K | 0.014 | 0.27 | 0.41 | 0.02 | 0.001 | 0.02 | 12.7 | 3.3 | 0.4 | 0.065 | 0.058 | 0.0034 | 1.16 | Nb: 0.061 |

TABLE 2

| Category | No | Type of steel | Quenching temperature (° C.) | Tempering temperature (° C.) | YS (MPa) | TS (MPa) | γ content (%) | Quenched martensite (vol %) | Tempered martensite (vol %) | Limit of expansion ratio (%) | Corrosion rate (mm/y) | Pitting corrosion |
|---|---|---|---|---|---|---|---|---|---|---|---|---|
| Inventive example | 1 | A | 890 | 640 | 740 | 945 | 27.7 | 0 | 72.3 | 55 | 0.075 | None |
| | 2 | B | 890 | 640 | 766 | 939 | 24.8 | 0 | 75.2 | 45 | 0.087 | None |
| | 3 | C | 890 | 640 | 773 | 942 | 24.1 | 0 | 75.9 | 45 | 0.092 | None |
| | 4 | D | 890 | 640 | 769 | 945 | 29.2 | 0 | 70.8 | 55 | 0.094 | None |
| | 5 | E | 890 | 640 | 751 | 933 | 26.2 | 0 | 73.8 | 55 | 0.070 | None |
| | 6 | F | 890 | 640 | 747 | 938 | 26.8 | 0 | 73.2 | 55 | 0.090 | None |
| | 7 | G | 890 | 640 | 759 | 934 | 25.6 | 0 | 74.4 | 50 | 0.089 | None |
| | 8 | H | 890 | 640 | 749 | 941 | 26.7 | 0 | 73.3 | 55 | 0.084 | None |
| | 9 | I | 890 | 640 | 755 | 949 | 25.9 | 0 | 71.5 | 50 | 0.083 | None |
| | 10 | A | 890 | 650 | 651 | 976 | 29.1 | 0 | 70.9 | 55 | 0.074 | None |
| | 11 | A | 680 | 630 | 767 | 975 | 32.4 | 0 | 67.6 | 60 | 0.071 | None |
| | 12 | A | 890 | 670 | 720 | 1031 | 20.2 | 6.9 | 72.9 | 50 | 0.070 | None |
| | 13 | B | 890 | 670 | 725 | 1069 | 21.5 | 8.3 | 70.2 | 50 | 0.082 | None |
| | 14 | F | 680 | 630 | 759 | 970 | 30.8 | 0 | 69.2 | 60 | 0.089 | None |
| Comparative example | 15 | J | 890 | 640 | 761 | 936 | 25.5 | 0 | 74.5 | 45 | 0.189 | None |
| | 16 | K | 890 | 640 | 841 | 944 | 19.1 | 0 | 80.9 | 30 | 0.097 | Observed |
| | 17 | B | 890 | 550 | 953 | 1019 | 2.4 | 0 | 97.6 | 25 | 0.091 | None |
| | 18 | B | 890 | 590 | 911 | 995 | 10.2 | 0 | 89.8 | 25 | 0.089 | None |
| | 19 | H | 890 | 550 | 961 | 1055 | 3.9 | 0 | 96.1 | 25 | 0.095 | None |

Example of Group 2 of the Invention

Molten steels having compositions shown in Table 3 were formed in a vacuum melting furnace, sufficiently degassed, and were each formed into a 100-kg steel ingot. The resulting ingots were subjected to hot piercing rolling with a research model seamless roll mill and were air-cooled to make pipes each having an outer diameter of 3.3 inches and a thickness of 0.5 inches. Specimens were cut out from the steel pipes and were subjected to quenching and tempering under the conditions shown in Table 4.

The specimens after the treatment were tested as follows.

Test for tensile properties: a tensile test according to ASTM A370 was performed in the longitudinal direction of each pipe to measure yield strength (YS) and tensile strength (TS).

Investigation of microstructure: A microstructure in the central portion in the thickness direction was exposed by etching. Tempered martensite, austenite, and quenched martensite phases were identified by image processing to determine the proportion (percent by volume) of each phase.

Expandability test: Each pipe was expanded by insertion of plugs, the diameters of the plugs being increased in such a manner that the expansion ratio ((plug diameter−initial inner diameter of pipe)/initial inner diameter of pipe×100 (%)) was increased in increments of 5%. Evaluation of expandability was performed on the basis of the expansion ratio (limit of expansion ratio) when the pipe during expanding was cracked. A target expansion ratio is 25% or more.

Corrosion test: Corrosion test pieces each having a thickness of 3 mm, a width of 30 mm, and a length of 40 mm were formed from 15%-expanded steel pipes by mechanical processing. A corrosion test was performed (conditions: the test pieces were immersed in an aqueous solution of 20% NaCl at 140° C. for two weeks, the solution being in equilibrium with a $CO_2$ atmosphere under a pressure of 30 atm). Evaluation of corrosion resistance was performed on the basis of the corrosion rate obtained by calculation from the reduction in weight of each test piece after the test and observation of the presence or absence of pitting corrosion with a 10-power loupe.

Table 4 shows the results. When the Cr content is less than 11.0%, the corrosion rate is increased. The allowable limit of the corrosion rate is 0.127 mm/y. When Mo is not contained, pitting corrosion occurs. The results clearly demonstrate that the steels according to the inventive examples have high expandability and excellent $CO_2$ corrosion resistance. Therefore, the steel pipes of the present invention can be sufficiently used as expandable oil country tubular goods.

TABLE 3

| Type of steel | Chemical composition (mass %) | | | | | | | | | | | | | |
|---|---|---|---|---|---|---|---|---|---|---|---|---|---|---|
| | C | Si | Mn | P | S | Al | Cr | Ni | Mo | V | N | O | Cu | Other |
| A1 | 0.007 | 0.29 | 0.46 | 0.02 | 0.001 | 0.02 | 12.4 | 5.3 | 1.9 | 0.050 | 0.007 | 0.0029 | — | — |
| B1 | 0.008 | 0.30 | 0.47 | 0.01 | 0.002 | 0.02 | 12.1 | 4.9 | 4.8 | 0.047 | 0.008 | 0.0056 | — | Nb: 0.050 |
| C1 | 0.004 | 0.24 | 0.50 | 0.01 | 0.002 | 0.02 | 12.2 | 4.9 | 2.5 | 0.051 | 0.009 | 0.0051 | — | Ti: 0.081 |
| D1 | 0.008 | 0.27 | 0.47 | 0.02 | 0.002 | 0.01 | 12.9 | 5.3 | 2.5 | 0.051 | 0.009 | 0.0045 | 1.23 | Zr: 0.014 |
| E1 | 0.005 | 0.20 | 0.41 | 0.02 | 0.002 | 0.01 | 12.1 | 5.0 | 2.1 | 0.049 | 0.004 | 0.0036 | 0.69 | Ti: 0.037, B: 0.001 |
| F1 | 0.009 | 0.25 | 0.44 | 0.02 | 0.002 | 0.02 | 12.8 | 4.6 | 2.4 | 0.049 | 0.006 | 0.0023 | — | Ca: 0.001 |
| G1 | 0.007 | 0.25 | 0.42 | 0.02 | 0.001 | 0.01 | 12.2 | 5.0 | 2.5 | 0.051 | 0.008 | 0.0049 | 0.92 | Nb: 0.061, Ca: 0.001 |
| H1 | 0.005 | 0.22 | 0.42 | 0.02 | 0.002 | 0.02 | 12.6 | 5.4 | 1.6 | 0.054 | 0.008 | 0.0054 | — | W: 0.72 |
| I1 | 0.009 | 0.28 | 0.48 | 0.02 | 0.001 | 0.01 | 12.2 | 5.2 | 1.7 | 0.044 | 0.006 | 0.0037 | — | — |
| J1 | 0.008 | 0.29 | 0.47 | 0.01 | 0.002 | 0.02 | 10.6 | 4.8 | 2.0 | 0.051 | 0.006 | 0.0085 | — | — |
| K1 | 0.006 | 0.24 | 0.45 | 0.01 | 0.001 | 0.01 | 12.0 | 4.7 | — | 0.045 | 0.008 | 0.0057 | 0.85 | Nb: 0.061 |

TABLE 4

| No | Type of steel | Quenching temperature (° C.) | Tempering temperature (° C.) | YS (MPa) | TS (MPa) | Austenite (vol %) | Quenched martensite (vol %) | Tempered martensite (vol %) | Limit of expansion ratio (%) | Corrosion rate (mm/y) | Pitting corrosion | Remarks |
|---|---|---|---|---|---|---|---|---|---|---|---|---|
| 101 | A1 | 890 | 650 | 596 | 795 | 25.7 | 0 | 74.3 | 55 | 0.079 | None | Inventive |
| 102 | B1 | 890 | 650 | 653 | 846 | 25.5 | 0 | 74.5 | 55 | 0.094 | None | example |
| 103 | C1 | 890 | 650 | 597 | 802 | 25.7 | 0 | 74.3 | 55 | 0.079 | None | |
| 104 | D1 | 890 | 650 | 629 | 837 | 27.7 | 0 | 72.3 | 55 | 0.072 | None | |
| 105 | E1 | 890 | 650 | 598 | 807 | 25.9 | 0 | 74.1 | 55 | 0.087 | None | |
| 106 | F1 | 890 | 650 | 625 | 826 | 24.1 | 0 | 75.9 | 55 | 0.075 | None | |
| 107 | G1 | 890 | 650 | 642 | 836 | 26.3 | 0 | 73.7 | 55 | 0.085 | None | |
| 108 | H1 | 890 | 650 | 620 | 818 | 26.8 | 0 | 73.2 | 55 | 0.076 | None | |
| 109 | I1 | 890 | 650 | 628 | 825 | 26.5 | 0 | 73.5 | 55 | 0.087 | None | |
| 110 | A1 | 890 | 670 | 564 | 792 | 28.9 | 0 | 71.1 | 60 | 0.076 | None | |
| 111 | A1 | 680 | 640 | 604 | 781 | 32.4 | 0 | 67.6 | 65 | 0.074 | None | |
| 112 | A1 | 890 | 690 | 534 | 897 | 20.7 | 7.9 | 71.4 | 50 | 0.081 | None | |
| 113 | B1 | 890 | 690 | 538 | 904 | 20.4 | 6.1 | 73.5 | 50 | 0.098 | None | |
| 114 | F1 | 690 | 640 | 545 | 837 | 29.1 | 0 | 70.9 | 60 | 0.073 | None | |
| 115 | J1 | 890 | 650 | 607 | 828 | 26.7 | 0 | 73.3 | 55 | 0.176 | None | Comparative |
| 116 | K1 | 890 | 640 | 582 | 836 | 27.5 | 0 | 72.5 | 55 | 0.103 | Observed | example |
| 117 | B1 | 890 | 540 | 762 | 899 | 3.7 | 0 | 96.3 | 25 | 0.102 | None | |
| 118 | B1 | 890 | 580 | 705 | 876 | 12.1 | 0 | 87.9 | 30 | 0.096 | None | |
| 119 | H1 | 890 | 540 | 741 | 892 | 3.8 | 0 | 96.2 | 25 | 0.078 | None | |

Example of Group 3 of the Invention

Molten steels having compositions shown in Table 5 were formed in a vacuum melting furnace, sufficiently degassed, and were each formed into a 100-kg steel ingot. The resulting ingots were subjected to hot piercing rolling with a research model seamless roll mill and were air-cooled to make pipes each having an outer diameter of 3.3 inches and a thickness of 0.5 inches. Specimens were cut out from the steel pipes and were subjected to quenching and tempering under the conditions shown in Table 6.

The specimens after the treatment were tested as follows.

Test for tensile properties: a tensile test according to ASTM A370 was performed in the longitudinal direction of each pipe to measure yield strength (YS) and tensile strength (TS).

Investigation of microstructure: A microstructure in the central portion in the thickness direction was exposed by etching. Tempered martensite, austenite, and quenched martensite phases were identified by image processing to determine the proportion (percent by volume) of each phase.

Expandability test: Each pipe was expanded by insertion of plugs, the diameters of the plugs being increased in such a manner that the expansion ratio ((plug diameter−initial inner diameter of pipe)/initial inner diameter of pipe×100 (%)) was increased. Evaluation of expandability was performed on the basis of the expansion ratio (limit of expansion ratio) when the pipe during expanding was cracked.

Corrosion test: Corrosion test pieces each having a thickness of 3 mm, a width of 30 mm, and a length of 40 mm were formed from tempered pipes by mechanical processing. A corrosion test was performed (conditions: the test pieces were immersed in an aqueous solution of 10% NaCl at 100° C. for two weeks, the solution being in equilibrium with a $CO_2$ atmosphere under a pressure of 30 atm). Evaluation of corrosion resistance was performed on the basis of the corrosion rate obtained by calculation from the reduction in weight of each test piece after the test and observation of the presence or absence of pitting corrosion with a 10-power loupe.

Table 6 shows the results. When the C content is 0.05% or less, a limit of expansion ratio of 40% or more was ensured. When Cr+0.5Ni−20C+0.45Cu+0.4W is 11.3 or less, the corrosion rate is increased. The results clearly demonstrate that the steels according to the inventive examples have high expandability and excellent $CO_2$ corrosion resistance. Therefore, the steel pipes of the present invention can be sufficiently used as expandable oil country tubular goods in oil well environments containing carbon dioxide gas.

TABLE 5

| Type of steel | Chemical composition (mass %) | | | | | | | | | | | | | Formula (1) |
|---|---|---|---|---|---|---|---|---|---|---|---|---|---|---|
| | C | Si | Mn | P | S | Al | Cr | Ni | V | N | O | Cu | Other | |
| A2 | 0.008 | 0.33 | 0.81 | 0.01 | 0.001 | 0.02 | 11.1 | 2.4 | 0.054 | 0.015 | 0.0035 | — | — | 12.14 |
| B2 | 0.013 | 0.32 | 0.84 | 0.02 | 0.002 | 0.02 | 12.0 | 2.0 | 0.052 | 0.022 | 0.0039 | — | Nb: 0.036 | 12.74 |
| C2 | 0.012 | 0.33 | 0.86 | 0.02 | 0.002 | 0.01 | 11.4 | 1.8 | 0.048 | 0.040 | 0.0066 | — | T1: 0.078 | 12.06 |
| D2 | 0.007 | 0.34 | 0.89 | 0.01 | 0.001 | 0.01 | 11.3 | 1.5 | 0.045 | 0.007 | 0.0037 | 0.62 | Zr: 0.019 | 12.19 |
| E2 | 0.018 | 0.30 | 0.88 | 0.02 | 0.001 | 0.01 | 10.9 | 2.3 | 0.051 | 0.031 | 0.0071 | 0.88 | Ti: 0.045, B: 0.001 | 12.09 |
| F2 | 0.028 | 0.33 | 0.85 | 0.02 | 0.001 | 0.01 | 11.2 | 1.8 | 0.046 | 0.024 | 0.0030 | — | Ca: 0.001 | 11.54 |
| G2 | 0.019 | 0.32 | 0.86 | 0.01 | 0.002 | 0.01 | 10.9 | 1.7 | 0.047 | 0.027 | 0.0035 | 1.31 | Nb: 0.069, Ca: 0.001 | 11.96 |
| H2 | 0.029 | 0.25 | 0.88 | 0.02 | 0.001 | 0.01 | 11.2 | 1.7 | 0.051 | 0.011 | 0.0047 | — | W: 0.95 | 11.85 |
| I2 | 0.026 | 0.29 | 0.86 | 0.01 | 0.001 | 0.02 | 11.3 | 1.9 | 0.051 | 0.020 | 0.0058 | — | — | 11.73 |
| J2 | 0.019 | 0.34 | 0.84 | 0.01 | 0.001 | 0.02 | 10.3 | 1.6 | 0.051 | 0.017 | 0.0094 | — | — | 10.72 |
| K2 | 0.055 | 0.31 | 0.95 | 0.01 | 0.001 | 0.01 | 11.1 | 1.5 | 0.054 | 0.028 | 0.0055 | 0.62 | Nb: 0.032 | 11.03 |

TABLE 6

| No | Type of steel | Quenching temperature (° C.) | Tempering temperature (° C.) | YS (MPa) | TS (MPa) | Austenite (vol %) | Quenched martensite (vol %) | Tempered martensite (vol %) | Limit of expansion ratio (%) | Corrosion rate (mm/y) | Pitting corrosion | Remarks |
|---|---|---|---|---|---|---|---|---|---|---|---|---|
| 201 | A2 | 890 | 700 | 537 | 695 | 9.7 | 0 | 90.3 | 50 | 0.081 | None | Inventive |
| 202 | B2 | 890 | 700 | 641 | 696 | 7.9 | 0 | 92.1 | 50 | 0.078 | None | example |
| 203 | C2 | 890 | 700 | 547 | 708 | 8.8 | 0 | 91.2 | 50 | 0.089 | None | |
| 204 | D2 | 890 | 700 | 634 | 686 | 6.5 | 0 | 93.5 | 50 | 0.082 | None | |
| 205 | E2 | 890 | 700 | 565 | 712 | 9.4 | 0 | 90.6 | 50 | 0.084 | None | |
| 206 | F2 | 890 | 700 | 607 | 752 | 8.5 | 0 | 91.5 | 50 | 0.108 | None | |
| 207 | G2 | 890 | 700 | 564 | 719 | 8.0 | 0 | 92.0 | 50 | 0.091 | None | |
| 208 | H2 | 890 | 700 | 612 | 766 | 8.4 | 0 | 91.6 | 50 | 0.094 | None | |
| 209 | I2 | 890 | 700 | 583 | 735 | 8.6 | 0 | 91.4 | 50 | 0.098 | None | |
| 210 | A2 | 890 | 720 | 564 | 667 | 14.6 | 0 | 85.4 | 55 | 0.076 | None | |
| 211 | A2 | 680 | 650 | 674 | 732 | 0 | 0 | 100 | 40 | 0.082 | None | |
| 212 | A2 | 890 | 760 | 509 | 755 | 13.7 | 8.7 | 77.6 | 55 | 0.084 | None | |
| 213 | B2 | 890 | 740 | 513 | 767 | 11.9 | 5.9 | 82.2 | 55 | 0.077 | None | |
| 214 | F2 | 890 | 650 | 604 | 805 | 0 | 0 | 100 | 40 | 0.103 | None | |
| 215 | J2 | 890 | 700 | 565 | 719 | 8.9 | 0 | 91.1 | 40 | 0.155 | Observed | Comparative |
| 216 | K2 | 890 | 700 | 655 | 793 | 6.4 | 0 | 93.6 | 35 | 0.135 | None | example |
| 217 | J2 | 890 | 650 | 595 | 769 | 0 | 0 | 100 | 35 | 0.158 | Observed | |

INDUSTRIAL APPLICABILITY

The stainless steel pipe of the present invention for oil country tubular goods has sufficient corrosion resistance and high workability in which the steel pipe can be expanded at a high expansion ratio even in high-temperature severe corrosion environments containing $CO_2$ and $Cl^-$. The stainless steel pipe is obtained by in 13% Cr steel having a C content markedly lower than that in the known art, limitation of contents of C, Si, Mn, Cr, Mo, Ni, N, and O, the formation of a microstructure mainly having a tempered martensitic phase with an austenite content exceeding 20 percent by volume or with a quenched martensite content of 3 percent by volume or more, and an austenite content of 15 percent by volume or more, optional limitation of contents of Cu, W, and the like, and the control of a microstructure. Therefore, the steel pipe of the present invention is suitable as oil country tubular goods used in the above-described severe corrosion environments. The steel of the present invention has excellent corrosion resistance and workability and thus can be applied to electric resistance welded pipes and UOE steel pipes.

The invention claimed is:

1. A stainless steel pipe having excellent expandability for oil country tubular goods, comprising a steel composition of, on a percent by mass basis, less than 0.010% C, 0.50% or less Si, 0.10% to 1.50% Mn, 0.03% or less P, 0.005% or less S, 11.0% to 15.0% Cr, 2.0% to 7.0% Ni, 3.0% or less Mo, 0.05% or less Al, 0.20% or less V, less than 0.01% N, 0.008% or less 0, and the balance being Fe and incidental impurities, wherein a steel microstructure has tempered martensite as a main phase and a quenched martensite content of 3 percent by volume or more and an austenite content of 15 percent by volume or more, said steel having been tempered at a temperature exceeding the $Ac_1$ temperature.

2. A stainless steel pipe having excellent expandability for oil country tubular goods, comprising a steel composition of, on a percent by mass basis, less than 0.010% C, 0.50% or less Si, 0.10% to 1.50% Mn, 0.03% or less P, 0.005% or less S, 11.0% to 15.0% Cr, 2.0% to 7.0% Ni, 3.0% or less Mo, 0.05% or less Al, 0.20% or less V, less than 0.01% N, 0.008% or less 0, at least one selected from 0.20% or less Nb, 3.5% or less Cu, 0.3% or less Ti, 0.2% or less Zr, 0.001% to 0.01% Ca, 0.0005% to 0.01% B, and 3.0% or less W, and the balance being Fe and incidental impurities, wherein a steel microstructure has tempered martensite as a main phase and a quenched martensite content of 3 percent by volume or more and an austenite content of 15 percent by volume or more, said steel having been tempered at a temperature exceeding the $Ac_1$ temperature.

* * * * *